United States Patent [19]

Morrell et al.

[11] Patent Number: 4,620,133

[45] Date of Patent: Oct. 28, 1986

[54] COLOR IMAGE DISPLAY SYSTEMS

[75] Inventors: Albert M. Morrell; Richard H. Hughes, both of Lancaster, Pa.; William H. Barkow, Pensauken, N.J.

[73] Assignee: RCA Corporation, Princeton, N.J.

[21] Appl. No.: 343,734

[22] Filed: Jan. 29, 1982

[51] Int. Cl.[4] ..... H01J 29/46; H01J 29/56

[52] U.S. Cl. ..... 315/15; 313/414

[58] Field of Search ..... 315/14, 15; 313/414, 313/444, 449

[56] References Cited

U.S. PATENT DOCUMENTS

| | | | |
|---|---|---|---|
| 3,548,249 | 12/1970 | Yoshida et al. . | |
| 3,772,554 | 11/1973 | Hughes . | |
| 3,873,879 | 3/1975 | Hughes | 315/14 |
| 4,049,991 | 9/1977 | Collins . | |
| 4,061,941 | 12/1977 | Hallett et al. . | |
| 4,143,345 | 3/1979 | Barkow . | |
| 4,253,041 | 2/1981 | Blacker et al. . | |
| 4,370,592 | 1/1983 | Hughes et al. . | |
| 4,383,199 | 5/1983 | Washino et al. | 315/15 |
| 4,388,552 | 6/1983 | Greninger . | |
| 4,443,736 | 4/1984 | Chen | 313/414 |
| 4,498,028 | 2/1985 | Gorski | 315/15 |

FOREIGN PATENT DOCUMENTS 2052845 5/1980 United Kingdom .

OTHER PUBLICATIONS

"New Color Picture Tube System for Portable TV Receivers", by Barbin and Hughes, in IEEE Transactions on Broadcast Television Receivers, vol. 18, 1972, pp. 193–200.

*Primary Examiner*—Theodore M. Blum

*Attorney, Agent, or Firm*—Eugene M. Whitacre; Paul J. Rasmussen; William H. Meagher

[57] ABSTRACT

Compact deflection yoke in self-converging display system encircles adjoining segments of neck and funnel sectons of color picture tube having close beam spacing (200 mils) in electron gun to achieve low S-spacing dimension between converging beams in deflection center plane. Neck diameter is sufficiently large (1145 mils) to accommodate main focusing lens having major transverse dimension more than three and half times the beam spacing in the electron gun. Main focusing lens is formed between final focus electrodes having recessed apertures at juxtaposed ends. Walls of successive recesses have "racetrack"-like and "dogbone"-like contours. Asymmetric beam forming lenses provide each beam traversing the main focusing lens with asymmetric cross-section having relatively reduced vertical dimension.

25 Claims, 17 Drawing Figures

COLOR IMAGE DISPLAY SYSTEMS

The present invention relates generally to color image display systems, and particularly to apparatus associating a compact deflection yoke with a multibeam color picture tube incorporating a low-aberration beam focusing lens to form a novel display system of the self-converging type capable of low-stored-energy operation without compromising beam focus performance or high voltage stability.

In the early use of multibeam color picture tubes of the shadow-mask type in color image display systems, dynamic convergence correction circuits were required to assure convergence of the beams at all points of the raster scanned on the viewing screen of the color picture tube. Subsequently, as described, for example, in U.S. Pat. No. 3,800,176—Gross, et al., a self-converged display system was developed which eliminated the need for dynamic convergence correction circuitry. In the system described in said Gross, et al. patent, three inline electron beams are subjected to deflection fields having nonuniformities introducing negative horizontal isotropic astigmatism and positive vertical isotropic astigmatism in a manner permitting attainment of substantial convergence at all raster points.

In initial commercial uses of the system described in said Gross, et al. patent, the center-to-center spacing between adjacent beams in a deflection plane (S-spacing) was held to less than 200 mils (i.e., less than 0.2 inch, or less than 5.08 mm) to ease the convergence requirements. Such close spacing between the beams imposed limitations on the diameters of beam position determining apertures which were disposed in transverse elements of the focus electrodes of the electron gun sources of the scanned beams. With the effective diameter of the focusing lens for each beam determined by the small diameters of such apertures, a beam spot distortion problem existed due to spherical aberration associated with the small diameter lenses.

In later commercial uses, a wider spacing between beams was adopted, permitting usage of larger diameter focus electrode apertures. This eased the spot distortion problem, at the expense, however, of increasing the difficulty of convergence attainment.

In a subsequent development in self-converging display systems, described, for example, in an article by E. Hamano, et al., entitled "Mini-Neck Color Picture Tube", appearing in the March-April 1980 issue of the Toshiba Review (pp. 23–26), a tube-yoke combination is employed in which a relatively compact deflection yoke is associated with a color picture tube having an outer neck diameter which is significantly smaller (22.5 mm.) than the outer neck diameters (29.11 mm, and 36.5 mm) which had theretofore been conventionally employed. In the Hamano, et al. article, horizontal deflection reactive power savings are associated with the neck diameter reduction, and improvements in deflection sensitivity of 20 to 30 percent (relative to conventional 29.1 mm neck systems) are claimed. The Hamano, et al. article, however, additionally recognizes that the neck diameter reduction imposes neck region dimensions that render it more difficult to attain achievement of satisfactory focus performance and high voltage stability (i.e., reliability against arcing).

The present invention is directed to a color image display system employing a tube/yoke combination in which deflection power savings, deflection sensitivity improvements, and yoke compactness comparable to those associated with the aforementioned "mini-neck" system are achievable without resort to neck diameter reduction. In the system of the present invention, a low S-spacing dimension (less than 200 mils) is employed, as in said "mini-neck" system, but, in contrast with the "mini-neck" system wherein the effective focus lens diameter is restricted to a dimension smaller than the center-to-center spacing between adjacent beams entering the lens, a focus electrode structure is employed which provides an asymmetrical main focus lens with a major transverse dimension significantly more than three times greater than such center-to-center beam spacing.

With the neck diameter reduction of the "mini-neck" system avoided in a system embodying the present invention, focus voltage levels comparable to those heretofore conventionally employed can be accommodated without compromise of high voltage stability, there being adequate room for appropriate spacing between the focus electrode structure and the interior walls. At such voltage levels, focus performance significantly improved over that provided by the aforementioned "mini-neck" system is readily attained. Alternatively, one may trade off some of said focus performance improvement for ease of focus voltage source requirements by operation at lower voltage levels.

In illustrative embodiments of the present invention, the tube/yoke combination employs a tube with a conventional 29.11 mm external neck diameter. Handling problems associated with the greater fragility of a 22.5 mm neck are avoided in both the manufacture of the tube and the assembly of the image display system. Evacuation time lengthening associated with evacuation of the mini-neck tube is also avoided.

In accordance with one illustrative embodiment of the present invention in which a 90° deflection angle is employed, a self-converged, 19V, image display is provided by a 29.11 mm neck tube with an S-spacing dimension less than 200 mils, cooperating with a compact deflection yoke of semi-toroidal type (i.e., having toroidal vertical deflection windings and saddle-type horizontal deflection windings), with the internal diameter of the yoke at the beam exit end of the windows of the horizontal deflection windings equal to approximately 2.64 inches (i.e., less than 30 mils per degree of deflection angle). Stored energy requirements for the horizontal deflection windings of the compact 90° yoke, with tube operation at 25 KV. ultor potential, are as little as 1.85 millijoules.

In accordance with another illustrative embodiment of the present invention in which a 110° deflection angle is employed, a self-converged, 19V, image display is provided by a tube of the aforementioned neck and S-spacing dimensions, cooperating with a compact semi-toroidal yoke having an internal diameter at the beam exit end of the windows of approximately 3.21 inches (i.e., again less than 30 mils per degree of deflection angle). Stored energy requirements for the horizontal deflection windings of the compact 110° yoke, with tube operation at 25 KV. ultor potential, are as little as 3.5 millijoules.

For appreciation of the relative compactness of the yokes in the above-described embodiments, it is noted that an illustrative value for the comparable internal diameter of a 90° deflection yoke extensively used in the past with tubes of the previously mentioned wide S-spacing type is 3.08 inches, while an illustrative internal diameter value for a 110° deflection yoke extensively used with tubes having the wide S-spacing dimensions is 4.28 inches (both diameter values being significantly greater than 30 mils per degree of deflection angle).

In both of the above-described illustrative embodiments, a high level of focus performance is assured by employing within the 29.11 mm neck a focus electrode structure of a general configuration disclosed in the co-pending U.S. patent application Ser. No. 201,692 of Hughes, et al. now U.S. Pat. No. 4,370,592. With such a configuration, the main focusing electrodes at the beam exit end of the electron gun assembly each include a portion disposed transversely with respect to the longitudinal axis of the tube neck and pierced by a trio of circular apertures, through each of which a respectively different one of the electron beams passes. Each of said main focusing electrodes also includes an adjoining portion extending longitudinally from said transverse portion and providing a commmon enclosure for the paths of all of said beams. The respective longitudinally extending portions of said main focusing electrodes are juxtaposed to define therebetween a common focusing lens for the beams. The major transverse interior dimension of the common enclosure of the final focusing electrode is, illustratively, 17.65 mm (695 mils), while the major transverse interior dimension of the common enclosure of the penultimate focusing electrode is, illustratively, 18.16 mm (715 mils). With such dimensions, advantage is taken of the increased interior space of a 29.11 mm (1145 mils) neck (relative to the aforementioned "mini-neck") to provide a focusing lens with a major transverse dimension at least three and one-half times greater than the center-to-center aperture spacing dimension. The difference between the respective transverse dimensions controls a desired converging effect for the beams emerging from the electron gun assembly.

In an illustrative form of the electron gun assembly of a system embodying the invention, the configuration of the internal periphery of the common enclosure of the penultimate focusing electrode is of a "racetrack" shape, as illustrated, for example, in the aforementioned Hughes, et al. patent, whereas the configuration of the internal periphery of the common enclosure of the final focusing electrode is of a modified, "dogbone" shape, as illustrated, for example, in the co-pending U.S. patent application Ser. No. 282,228, of P. Greninger, now U.S. Pat. No. 4,388,552. Additionally, there is associated with the beam forming region of the electron gun assembly a lens asymmetry of a type reducing the vertical dimension of each beam's cross section at the entrance of the main focus lens relative to the horizontal dimension thereof. Illustratively, this asymmetry is introduced by the association of a vertically extending, rectangular slot with each circular aperture of the first grid (G1) of the electron gun assembly.

By suitable choice of the dimensions of the "racetrack" enclosure, "dogbone" enclosure and G1 slots, an acceptable spot shape at both center and edges of the display raster is achievable by an optimized balance of the astigmatisms associated with these elements.

In the accompanying drawings:

FIG. 1 provides a plan view of a picture tube/yoke combination in accordance with an embodiment of the present invention;

FIG. 2 provides a front end view of the yoke assembly of the FIG. 1 apparatus;

FIG. 3 provides a side view, partially in section, of an electron gun assembly for use in the neck portion of the picture tube of the FIG. 1 apparatus;

FIGS. 4, 5, 6 and 7 provide respective end views of different elements of the gun assembly of FIG. 3;

FIG. 7*a* provides a cross-sectional view of the gun element of FIG. 7, taken along lines A—A' in FIG. 7;

FIG. 7*b* provides a cross-sectional view of the gun element of FIG. 7, taken along lines B—B' in FIG. 7;

FIG. 8 provides a cross-sectional view of the gun element of FIG. 4, taken along lines C—C' in FIG. 4;

FIG. 9 provides a cross-sectional view of the gun element of FIG. 5, taken along lines D—D' in FIG. 5.

FIG. 10 provides a cross-sectional view of the gun element of FIG. 6, taken along lines E'—E' in FIG. 6;

Figure 1:
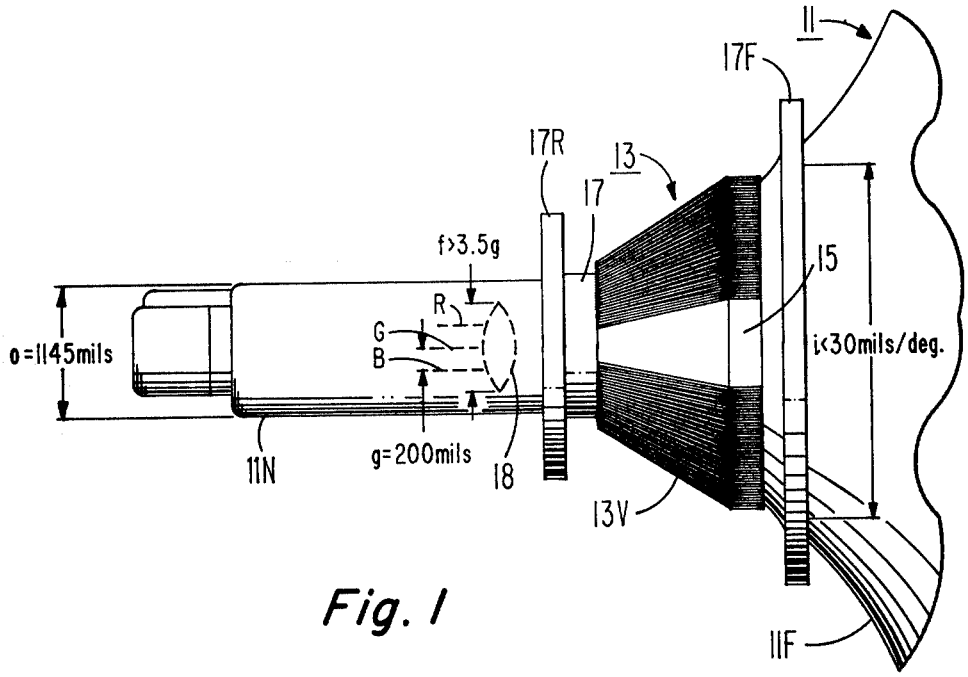
Figure 2:
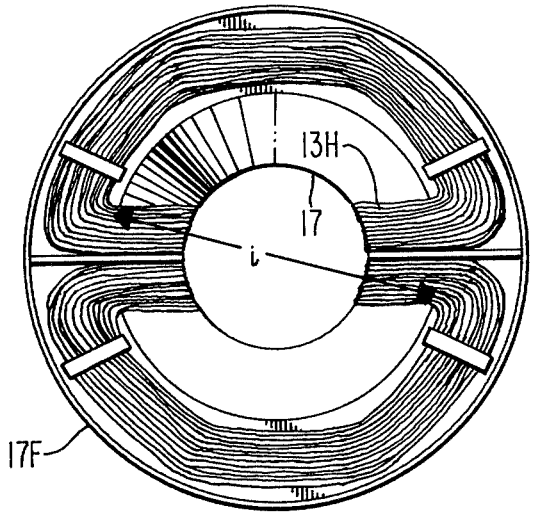
Figure 14A:
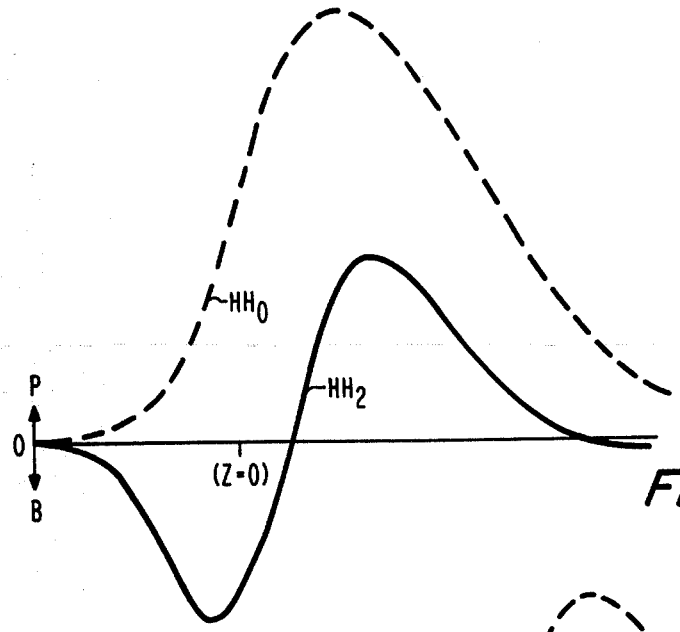
Figure 14B:
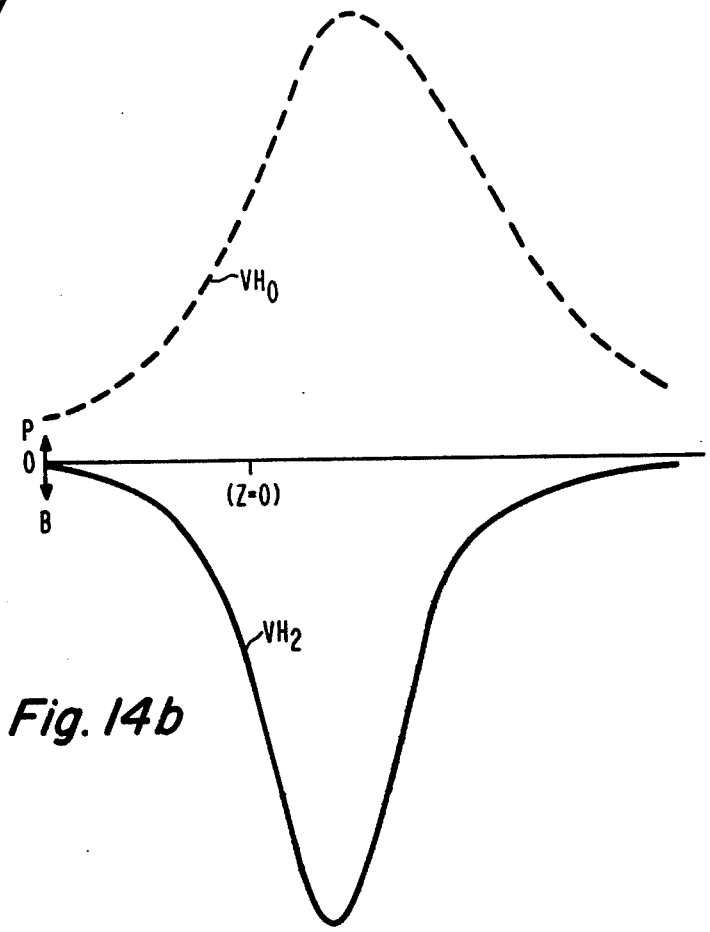

FIGS. 14*a*, 14*b* illustrate graphically nonuniformity functions desirably associated with an embodiment of the FIG. 2 yoke assembly;

FIG. 1 provides a plan view of the picture-tube/yoke combination of a color image display system embodying the principles of the present invention. A color picture tube 11 includes an evacuated envelope having a funnel portion 11F (partially illustrated), linking a cylindrical neck portion 11N (housing an in-line electron gun assembly) to a substantially rectangular screen portion enclosing a display screen (not illustrated because of drawing size considerations). Encircling adjoining segments of the tube's neck (11N) and funnel (11F) portions is the yoke mount 17 of a deflection yoke assembly 13.

The yoke assembly 13 includes vertical deflection windings 13V toroidally wound about a core 15 of magnetizable material, which encircles the yoke mount 17 (formed of insulating material). The yoke assembly additionally includes horizontal deflection windings 13H which are masked from view in FIG. 1. As shown, however, in a front end view of the dismounted yoke assembly 13 in FIG. 2, the horizontal deflection windings 13H are wound in a saddle configuration, with active, longitudinally extending, conductors lining the interior of the throat of the yoke mount 17. The front end turns of windings 13H are upturned and nested in the front rim portion 17F of mount 17, with the rear end turns (not visible in FIGS. 1 or 2) similarly disposed in the rear rim portion 17R of mount 17.

Designations of dimensional relationships appropriate to an embodiment of the present invention appear in FIG. 1. The compactness of the deflection yoke formed by windings 13H, 13V is indicated by a front internal diameter "i" which totals less than 30 mils per degree (of the deflection angle provided by the yoke). As shown in FIG. 2, this diameter is measured at the front end of the active conductors of the saddle windings 13H (i.e., at the beam exit end of the windows formed by these windings). The outer diameter "o" of the neck portion 11N of color picture tube 11 is shown to be conventional 1145 mils (i.e., 29.11 mm). An electrostatic beam focusing lens 18, formed between electrodes of the electron gun assembly housed in neck 13 (and indicated by a dotted-line lens symbol), is shown to have a transverse dimension "f" in the horizontal direction (i.e., in horizontal plane occupied by the trio of beam axes, R, G and B) which is more than three and one-half times the spacing "g" between adjacent beam axes at the lens entrance, the latter dimension being illustratively 200 mils.

Figure 3:
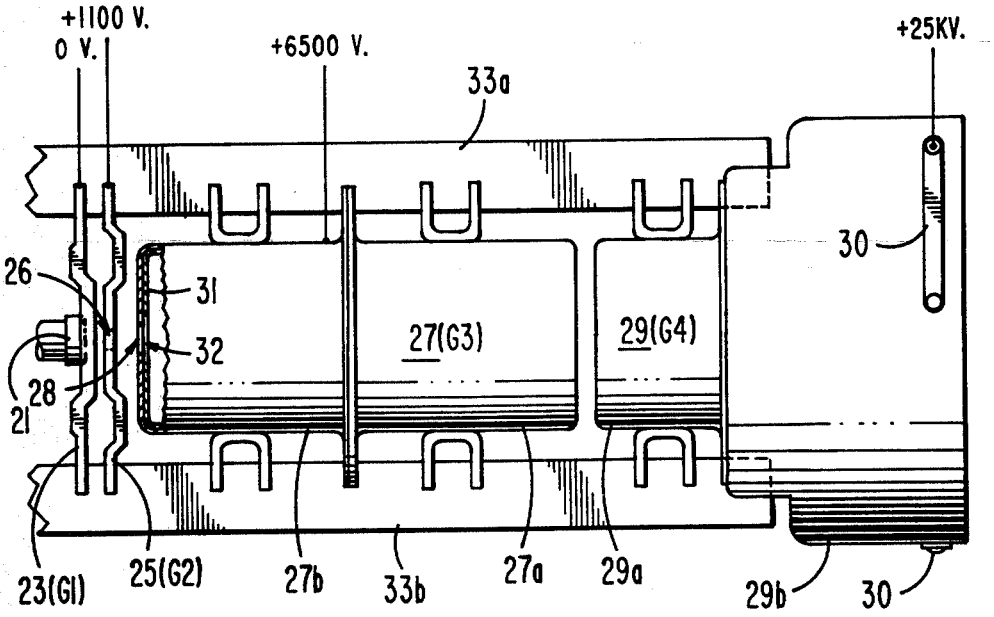

FIG. 3 provides a side view, partly in section, of an illustrative electron gun assembly suitable for use in the neck portion 11N of the color picture tube 11 of FIG. 1. The electrodes of the gun assembly of FIG. 3 include a trio of cathodes 21 (one of which is visible in the side view of FIG. 3), a control grid 23 (G1), a screen grid 25 (G2), a first accelerating and focusing electrode 27 (G3), and a second accelerating and focusing electrode 29 (G4). A mount for the gun elements is provided by a pair of glass support rods 33*a*, 33*b*, which are disposed in parrallel relationship, and between which the various electrodes are suspended.

Each of the cathodes 21 is aligned with respective apertures in the G1, G2, G3, and G4 electrodes to allow passage of electrons emitted by the cathode to the picture tube screen. The electrons emitted by the cathodes are formed into a trio of electron beams by respective electrostatic beam forming lenses established between opposing apertured regions of the G1 and G2 electrodes 23, 25, which are maintained at different unidirectional potentials (e.g., 0 volts and +1100 volts, respectively). Focusing of the beams at the screen surface is primarily effected by a main electrostatic focusing lens (18 in FIG. 1) formed between adjoining regions (27*a*, 29*a*) of the G3 and G4 electrodes. Illustratively, the G3 electrode is maintained at a potential (e.g., +6500 volts) which is 26% of the potential (e.g., +25 kilovolts) applied to the G4 electrode.

Figure 4:
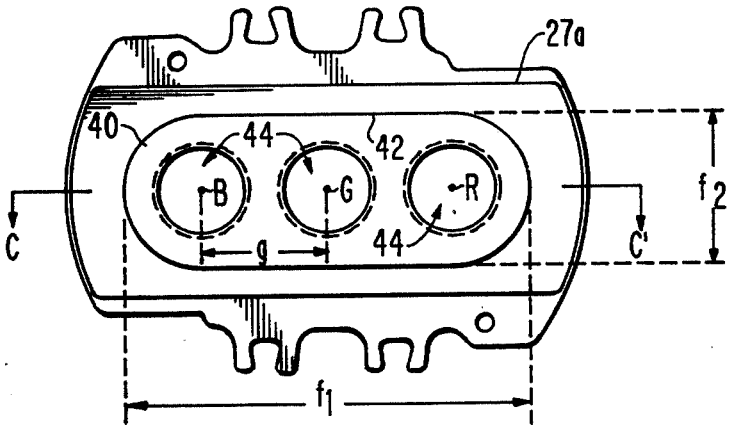
Figure 6:
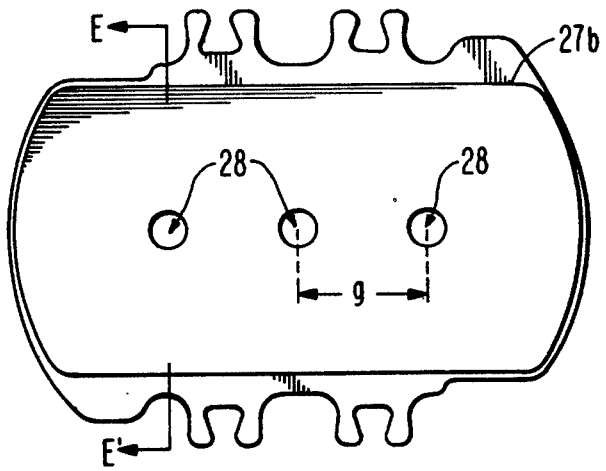

The G3 electrode 27 comprises an assembly of two cup-shaped elements 27*a*, 27*b*, with their flanged open ends abutting. A front end view of the forward element 27*a* is presented in FIG. 4, and a cross-sectional view thereof (taken along lines C—C' of FIG. 4) appears in FIG. 8. A rear end view of the rearward element 27*b* is shown in FIG. 6, and a cross-sectional view thereof (taken along lines E—E' of FIG. 6) appears in FIG. 10.

Figure 5:
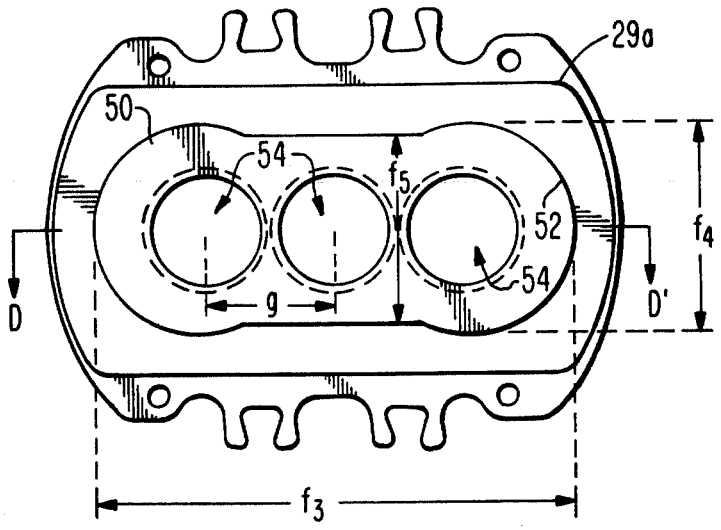

The G4 electrode 29 comprises a cup-shaped element 29*a* with its flanged open end abutting the apertured closed end of an electrostatic shield cup 29*b*. A rear end view of element 29*a* is presented in FIG. 5, and a cross-sectional view thereof (taken along lines D—D' of FIG. 5) appears in FIG. 9.

A trio of in-line apertures 44 are formed in a transverse portion 40 of G3 element 27*a*, which portion is situated at the bottom of a recess in the element's closed front end. The walls 42 of the recess, which define a common enclosure for the trio of beams emerging from the respective apertures 44, have a semi-circular contour at each side, while extending therebetween in straight, parallel fashion, thus presenting a "racetrack" appearance in the end view of FIG. 4. The maximum horizontal interior dimension of the G3 enclosure lies in the plane of the beam axes and is designated "$f_1$" in FIG. 4. The maximum vertical interior dimension of the G3 enclosure is determined by the spacing between the straight, parallel wall portions and is designated "$f_2$" in FIG. 4. The vertical dimension is equal to $f_2$ at each of the beam axis locations.

A trio of in-line apertures 54 are also formed in a transverse portion 50 of G4 element 29*a*, which portion is situated at the bottom of a recess in the element's closed rear end. The walls 52 of the recess, which define a common enclosure for the trio of beams entering the G4 electrode are disposed in straight, parallel relationship in a central region. The contour at each side, however, follows a greater-than-semicircle arc of a diameter greater than the spacing between parallel walls in the central region, resulting in presentation of a "dogbone" appearance in the end view of FIG. 5. As a consequence of this shaping, the vertical interior dimension ($f_5$) of the G4 enclosure at the central aperture axis location is less than the vertical interior dimensions of the G4 enclosure at the respective outer aperture axis locations. The maximum horizontal interior dimension of the G4 enclosure lies in the plane of the beam axes, and is designated "$f_3$" in FIG. 5. The maximum vertical interior dimension of the G4 enclosure corresponds to the diameter associated with the end region arcs, and is designated "$f_4$" in FIG. 5.

Figure 8:
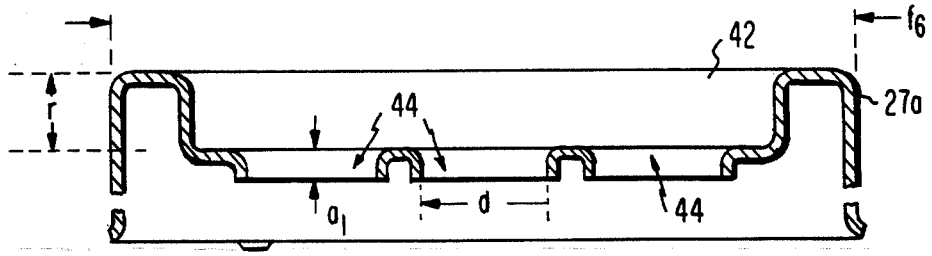
Figure 9:
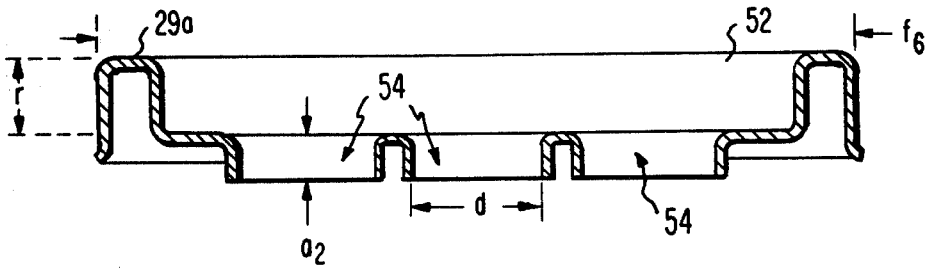

The maximum exterior widths of the G3 and G4 electrodes in the respective "racetrack" and "dogbone" regions are the same, and are designated "$f_6$" in FIGS. 8 and 9. The diameters of the apertures 44 and 54 are also the same, and are designated "d" in FIGS. 8 and 9. Also equal are the recess depths (r in FIGS. 8 and 9) for the G3 and G4 electrodes. Dissimilar are the G3 aperture depth ($a_1$, FIG. 8) and the G4 aperture depth ($a_2$, FIG. 9). Illustrative dimensional values for d, $f_1$, $f_2$, $f_3$, $f_4$, $f_5$, $f_6$, r, and $a_1$ and $a_2$ are, as follows: d=160 mils (4.064 mm); $f_1$=715 mils (18.16 mm); $f_2$=315 mils (8.000 mm); $f_3$=695 mils (17.65 mm); $f_4$=285 mils (7.240 mm); $f_5$=270 mils (6.86 mm); $f_6$=875 mils (22.22 mm); r=115 mils (2.92 mm); $a_1$=34 mils (0.86 mm); and $a_2$=45 mils (1.14 mm). The illustrative dimension for the center-to-center spacing (g) between adjacent apertures in each of the focusing electrodes is, as discussed in connection with FIG. 1, equal to 200 mils (5.08 mm). Illustrative axial lengths for elements 27*a*, 29*a* are 490 mils (12.45 mm) and 120 mils (3.05 mm), respectively, while an illustrative G3–G4 spacing for the assembly of FIG. 3 is 50 mils (1.27 mm).

Predominantly, the main focusing lens formed between elements 27*a* and 29*a* appears as a single large lens intersected by all three electron beam paths, with equipotential lines, of relatively shallow curvature in regions intersecting beam paths, extending continuously between opposing recess walls. In contrast, in prior art guns lacking the recess feature, the predominant focusing effect was provided by strong equipotential lines of relatively sharp curvature concentrated at each of the non-recessed aperture regions of the focus electrodes. With the recess feature presence in the illustrated arrangement of elements 27*a*, 29*a*, equipotential lines of relatively sharp curvature at the aperture regions have only a small role in determination of the quality of focus performance (which is rather determined predominately by the size of the large lens associated with the recess walls).

As a consequence, one may employ a close beam spacing dimension (such as the previously mentioned 200 mils value) despite the resultant limitation on aperture diameter, with assurance that the level of undesirable spherical aberration effects will be relatively independent of aperture diameter value and primarily governed by the dimensions of the large lens defined by the recess walls. Under these circumstances, neck diameter becomes a limiting factor on focus performance. In use of the illustrative dimension set presented above for the focusing system of the present invention, excellent focus quality is attainable with focus electrode exterior dimensions (e.g., see $f_6$) which are readily accommodated within a neck of the indicated conventional diameter dimension (i.e. 1145 mils, 29.11 mm) allowance for spacings from interior envelope walls consonant with good high voltage stability performance (even under worst case glass tolerance conditions). In contrast, the neck of the "mini-neck" tube described in the above-discussed Hamano, et al. article could not accommodate a focus electrode structure of such illustrative dimensions.

The converging side of the main electrostatic beam focusing lens 18 is associated with the recess of element 29*a*, which, as described above, has a periphery of racetrack-like contour. The horizontal-versus-vertical asymmetry of such a configuration results in an astigmatic effect: a greater converging effect on vertically spaced rays of an electron beam traversing the G3 electrode recess than on horizontally spaced rays thereof. If the juxtaposed recess of the G4 electrode is provided with a similar "racetrack" contour, the diverging side of the main focusing lens 18 also exhibits an astigmatic effect of a compensating sense but inadequate in magnitude to prevent existence of a net astigmatism that can preclude attainment of a desirable spot shape at the display screen.

One solution to achievement of the additional astigmatism compensation desired is, as described in the aforementioned Hughes, et al. patent, association of a slot forming pair of horizontal strips with the apertures of a transverse plate present at the interface of elements 29*a*, 29*b*. Illustrative dimension choices for such a solution are presented in said Hughes, et al. application which is incorporated by reference herein for the purpose of disclosure.

Another solution to achievement of the additional astigmatism compensation desired is, as described in the aforementioned Greninger patent, modification of the contour of the recess walls in the G4 electrode to a "dogbone" shape, with the degree of vertical dimension reduction associated with the central region of the "dogbone" either selected to obtain substantially full compensation of the astigmatism in the diverging portion of the main focusing lens itself, or to supplement the compensating effect of a G4 slot of the above-described type. Illustrative dimension choices for such a solution are presented in said Greninger patent which is incorporated by reference herein for the purpose of disclosure.

Figure 7:
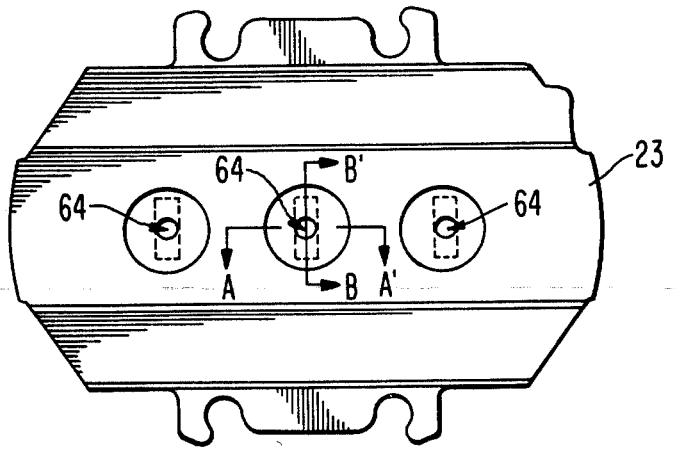
Figure 7A:
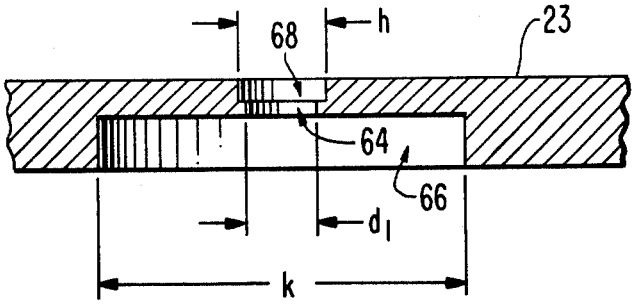
Figure 7B:
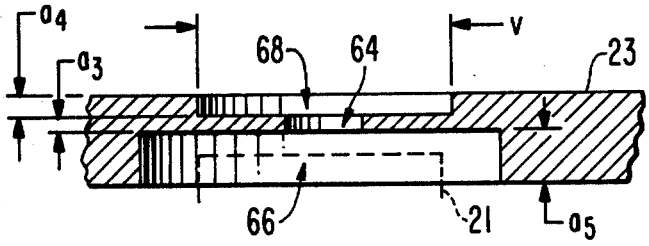

A different solution to the astigmatism compensation problem is employed herein, where the compensating effect of "dogbone" shaping of the contour of the G4 recess walls is combined with a compensating effect obtained by introducing an appropriate asymmetry to the beam forming lenses defined by the G1 and G2 electrodes (23, 25). To appreciate the nature of the latter compensating effect, it is appropriate to now consider the structure of the G1 electrode 23, as best illustrated by the rear end view thereof presented in FIG. 7, and the associated cross-sectional views of FIGS. 7*a* and 7*b*.

The central region of the G1 electrode 23 is pierced by a trio of circular apertures 64 (of a diameter $d_1$), with each of the apertures communicating with a recess 66 in the rear surface of the electrode 23, and a recess 68 in the front surface of the electrode 23. Each rear surface recess 66 has walls of circular contour, with the recess diameter "k" sufficiently large to receive the forward end of a cathode 21 (outlined in dotted lines in FIG. 7*b*) with suitable spacing from the recess walls. The walls of each front surface recess 68 have a contour defining a rectangular slot, with the vertical slot dimension "v" significantly larger than the horizontal slot dimension "h". The center-to-center spacing (g) between adjacent apertures 64 is the same as provided for the G3 and G4 electrode apertures previously discussed. Illustrative values for the other dimensions of G1 electrode 23 are, as follows: $d_1$=25 mils (0.615 mm); k=125 mils (3.075 mm); h=28 mils (0.711 mm); v=84 mils (2.134 mm); depth of aperture 64 ($a_3$)=4 mils (0.102 mm); depth of slot 68 ($a_4$) 8 mils (0.203 mm); depth of recess 66 ($a_5$)=18 mils (0.457 mm). When assembled with cathode 21 and G2 electrode 25, an illustrative value for the spacing between cathode 21 and the base of recess 64 is 6 mils (0.152 mm), while an illustrative value for the G1–G2 spacing is 7 mils (0.178 mm).

In the assembled condition illustrated in FIG. 3, each of three circular apertures 26 in the G2 electrode 25 is aligned with one of the apertures 64 of the G1 electrode. The presence of each interposed slot 68 introduces an asymmetry in the convergent side of each of the G1–G2 beam forming lenses. The effect is location of a crossover for vertically spaced rays of each beam farther forward along the beam path than the crossover location for horizontally spaced rays of the beam. As a consequence, the cross-section of each beam entering the main focusing lens has a horizontal dimension larger than its vertical dimension. This "predistortion" of the beam's cross-sectional shape is of a sense tending to compensate for the spot distortion effects of the astigmatism of the main focusing lens.

One of the advantages accruing from the use of the above-described "pre-distortion" of the beams entering the main focusing lens is enhanced equalization of the focus quality in the vertical and horizontal dimensions. The asymmetry of the main focusing lens is such that its vertical dimensions in lens regions intersected by the beam paths, while being significantly larger than the diameter of the focus electrode apertures (which limited focusing lens size in prior art guns discussed previously), are, nevertheless, smaller than its horizontal dimensions in such regions. Thus, vertically spaced rays of each beam see a smaller lens than the lens seen by horizontally spaced rays thereof. The above-described "pre-distortion" confines the vertical spread of each beam during traversal of the main focusing lens so that the separation of vertical boundaries of a properly centered beam traversing the smaller, lower quality, vertical lens is less than the separation of the horizontal boundaries of a beam traversing the larger, higher quality horizontal lens.

Another of the advantages accruing from the use of the above-described "pre-distortion" of the beams entering the main focusing lens is avoidance or reduction of vertical flare problems at raster top and bottom that are associated with undesired vertical deflection of the points of entry of the beams into the main focusing lens in response to a fringe field of the toroidal vertical deflection windings 13V appearing at the rear of the yoke assembly 13. While, as will be described subsequently, an effort is made to provide some magnetic shielding of the beams from this fringe field, particularly in low velocity regions of their paths, succeeding regions of their paths are subtantially unshielded from this fringe field. The above-described confinement of the vertical spread of each beam during traversal of the main focusing lens reduces the likelihood that deflection of the entry point by the fringe field will push boundary rays out of relatively unaberrated lens regions.

Another of the advantages arising from the use of the above-described "pre-distortion" of the beams entering the main focusing lens is a lessening of adverse effects of the main horizontal deflection field provided by the saddle windings 13H on spot shapes at the raster sides. To produce the desired self-converging effects required of yoke assembly 13, the horizontal deflection field is strongly pincushioned over a substantial portion of the axial length of the beam deflection region. An unfortunate consequence of such non-uniformities of the horizontal deflection field is a tendency to cause over-focusing of the vertically spaced rays of each beam at the raster sides. With the above-described "pre-distortion" use, the vertical dimension of each beam during its travel through the deflection region is sufficiently compressed that the over-focusing effects at the raster sides are reduced to a tolerable level.

Reference may be made to U.S. Pat. No. 4,234,814 Chen, et al. for a description of an alternative approach to achievement of the above-described "pre-distortion" of the beams. In the structure of the Chen, et al. patent, a rectangular slot recess, elongated in the horizontal direction, appears in the rear surface of the G2 electrode in alignment and communication with each circular aperture of the G2 electrode. Thus, in the Chen, et al. arrangement, a compression of the vertical dimension of each beam traversing the main focusing lens relative to its horizontal dimension is achieved by introduction of asymmetry in the divergent portion of each beam forming lens. An advantage of the previously described association of the asymmetry with the G1 electrode in the described electron gun system has been observed to be attainment of an advantageous improvement in depth of focus in the vertical direction. The attained depth of focus is such that the focus voltage adjusting potentiometer, normally provided in the display system, may be employed to vary the precise value of the focus voltage (applied to the G3 electrode 27) over a suitable range to optimize the focus in the horizontal direction without concern for significant disturbance of the focus in the vertical direction.

Figure 10:
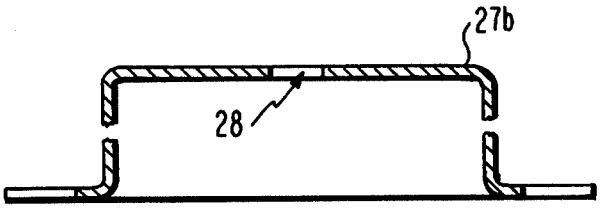

As mentioned previously, it is desirable to shield low velocity regions of the respective beam paths from rearwardly directed fringe fields of the deflection yoke. For this purpose, a cup-shaped magnetic shield element 31 is fitted within the rear element **27*b* of the G3 electrode 27 and secured thereto (e.g., by welding) with its closed end abutting the closed end of element 27*b* (as shown in the assembly drawing of FIG. 3). As shown in FIGS. 6 and 10, the closed end of the cup-shaped element 27*b* is pierced by a trio of in-line apertures 28 having walls of circular contour. The closed end of the magnetic shield insert 31 is similarly pierced by a trio of in-line apertures 32 having walls of circular contour, which are aligned and communicating with the apertures 28 when insert 31** is fitted in place.

In the assembly of FIG. 3, the apertures 28 are aligned with but axially spaced from, the apertures 26 of the G2 electrode 25. Illustrative dimensions for this segment of the assembly include: aperture 26 diameter=25 mils (0.615 mm); aperture 26 depth=20 mils (0.508 mm); aperture 28 diameter=60 mils (1.524 mm); aperture 28 depth=10 mils (0.254 mm); aperture 32 diameter=100 mils (2.54 mm); and aperture 32 depth=10 mils (0.254 mm); with axial spacing between aligned apertures 26, 28 equal to 33 mils (0.838 mm), and with center-to-center spacing between adjacent ones of each aperture trio equal to the previously mentioned "g" value of 200 mils (5.08 mm). An illustrative axial length for the magnetic shield insert 31 is 212 mils (5.38 mm), compared with illustrative axial lengths for G3 elements **27*b* and 27*a* of 525 mils (13.335 mm) and 490 mils (12.45 mm). Such a shield length (less than one-fourth of the overall length of the G3 electrode) represents an acceptable compromise between conflicting desires to shield the beam paths in the pre-focus region, and to avoid field distortion disturbing corner convergence. Illustratively, the shield 31** is formed of a magnetizable material (e.g., a nickel-iron alloy of 52% nickel and 48% iron) having a high permeability relative to the permeability of the material (e.g., stainless steel) employed for the focus electrode elements.

The forward element **29*b* of the G4 electrode 29 includes a plurality of contact springs 30 on its forward periphery for contacting the conventional internal aquadag coating of the picture tube to effect delivery of the ultor potential (e.g., 25 KV) to the G4 electrode. The closed end of the cup-shaped element 29*b* includes a trio of in-line apertures (not shown) of the illustrative 200 mils center-to-center spacing for passing the respective beams departing the main focusing lens. High permeability magnetic members, affixed to the interior surface of the closed end of element 29*b*** in the aperture vicinities, are desirably provided for coma correction purposes, as described, for example, in U.S. Pat. No. 3,772,554—Hughes.

Delivery of operating potentials to the other electrodes (cathode, G1, G2 and G3) in the FIG. 3 assembly is effected through the base of the picture tube via conventional lead structures (not illustrated).

The main focusing lens formed between the G3 and G4 electrodes (27, 29) of the FIG. 3 assembly has a net converging effect on the trio of the beams traversing the lens, whereby the beams depart the lens in converging fashion. The relative magnitudes of the horizontal dimensions of the juxtaposed enclosures of elements **27*a*, 29*a*** affect the magnitude of the converging action, with converging action enhancement associated with a dimensional ratio favoring the G4 enclosure width and with converging action reduction associated with a dimensional ratio favoring the G3 enclosure width. In the embodiment example for which dimensions have been presented above, converging action reduction was desired, with a G3–G4 enclosure width ratio of 715/695 found to be appropriate.

In use of the display system of FIG. 1, additional neck encircling apparatus (not illustrated) may be conventionally employed to adjust the convergence of the beams at the raster center (i.e., static convergence) to an optimum condition. Such apparatus may be of the adjustable magnetic ring type generally disclosed in U.S. Pat. No. 3,725,831—Barbin, for one example, or of the sheath type generally disclosed in U. S. Pat. No. 4,162,470—Smith, for another example.

Figure 13:
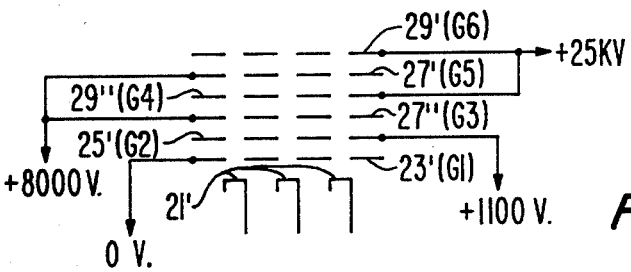
FIG. 13 illustrates schematically a modification of the electron gun assembly of FIG. 3.

FIG. 13 illustrates schematically a modification of the electron gun assembly of FIG. 3 which may be alternatively employed in the FIG. 1 apparatus. Pursuant to the modification, a pair of auxiliary focusing electrodes (27″, 29″) are interposed between the screen grid (25′) and the main accelerating and focusing electrodes (27′, 29′). The main focusing lens is defined between these final electrodes (27′, 29′), which, in this instance, constitute G5 and G6 electrodes. The initially traversed one of the auxiliary focus electrodes (G3 electrode 27″) is energized by the same potential (illustratively, +8000 v.) as the G5 electrode 27, while the other auxiliary focus electrode (G4 electrode 29'') is energized by the same potential (illustratively, +25 KV.) as the G6 electrode 29. As in the FIG. 3 embodiment, the individual beams are formed (of electrons emitted from the respective cathodes 21') by respective beam forming lenses established between the control grid (G1 electrode 23') and the screen grid (G2 electrode 25').

In realization of this alternative embodiment, the G5 and G6 electrodes (27'' and 29'') are illustratively of the general form assumed by the G3 and G4 electrodes (27, 29) of the FIG. 3 assembly, with juxtaposed enclosures of the "racetrack" and "dogbone" form and dimensional order discussed previously, bottoming on recessed apertures with center-to-center spacing of the above-discussed 200 mils value. "Predistortion" of the beams, of the type previously described, is introduced by an asymmetry of the respective beam forming lenses. Illustratively, this is provided by structural forms for the G1 and G2 electrodes (23', 25') of the type disclosed in the aforementioned Chen, et al. patent, whereby horizontally oriented rectangular slots are associated with the rear surface of the G2 electrode (23') to intervene between G2 and G1 circular aperture trios with center-to-center spacings of the aforementioned 200 mils value. The interposed auxiliary focus electrodes (27'', 29''), which are illustratively formed from cup-shaped elements having bottoms pierced by additional in-line circular aperture trios (of the aforementioned center-to-center spacing dimension), introduce symmetrical G3–G4 and G4–G5 lenses, with a net effect of a symmetrical reduction in the cross-sectional dimensions of the beam traversing the main focusing lens and the subsequent deflection region. This dimensional reduction may be desired to lessen overfocusing effects of the horizontal deflection field on spot shape at the raster sides, but such lessening is achieved at the expense of providing a larger center spot size than is achievable with the simpler bipotential focus system of FIG. 3. In use of the FIG. 13 arrangement, the low velocity beam path region shielding effect discussed previously in connection with insert 31 is illustratively matched by forming the G3 electrode (27'') of high permeability material.

Figure 11:
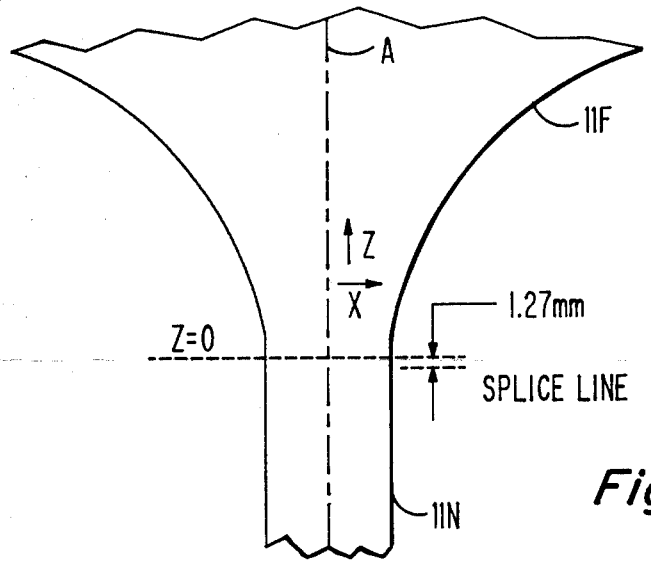
FIG. 11 illustrates a picture tube funnel contour suitable for use in an embodiment of the present invention employing a 90° deflection angle.

To enhance the sensitivity of the deflection yoke in the FIG. 1 system, it is desirable that the contour of a conical segment of the funnel portion (11F) of the tube envelope in the deflecting region be chosen to allow the active conductors of deflection windings 13H of the compact yoke to lie as close to the outermost beam path (directed to a raster corner) as is consonant with avoidance of neck shadow (striking of the funnel's interior surface by the deflected beam). FIG. 11 illustrates a funnel contour determined to be appropriate for an embodiment of the FIGURE 1 system in which a 90° deflection angle is employed. A mathematical formula expressing the illustrated contour is, as follows: $X=C0+C1(Z)+C2(Z^2)+C3(Z^3)+C4(Z^4)+C5(Z^5)+C6(Z^6)+C7(Z^7)$; where X is the cone radius measured from the longitudinal axis (A) of the tube to the outer surface of the envelope, expressed in millimeters; Z is distance in millimeters along the axis A, in the direction of the display screen, from a Z=0 plane intersecting the axis at a point 1.27 mm forward of the neck/funnel splice line; where C0=15.10490500, C1=0.1582240210, C2=0.01162553080, $C3=8.880522990\times10^{-4}$, $C4=3.877228960\times10^{-5}$, $C5=7.249226520\times10^{-7}$, $C6=6.723851420\times10^{-9}$, and $C7=2.482776160\times10^{-11}$; with the expression valid for values of Z from 9.35 to 52.0 mm.

Figure 12:
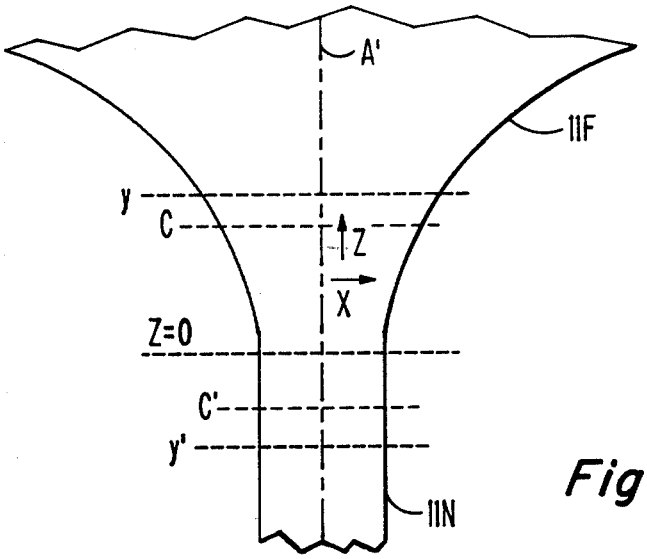
FIG. 12 illustrates a picture tube funnel contour suitable for use in an embodiment of the present invention employing a 110° deflection angle.

FIG. 12 illustrates a funnel contour determined to be appropriate for an embodiment of the FIG. 1 system in which a 110° deflection angle is employed. A mathematical formula expressing the illustrated contour is, as follows:

$X=C0+C1(Z)+C2(Z^2)+C3(Z^3)+C4(Z^4)+C5(Z^5)$, where X is the cone radius measured from the longitudinal axis A' to the outer surface of the envelope, expressed in millimeters; Z is the distance in millimeters along the axis A', in the direction of the display screen, from a Z=0 plane intersecting the axis at a point 1.27 mm forward of the neck/funnel splice line; where C0=14.5840702, where C1=0.312534174, where C2=0.0242187585, $C3=6.99740898\times10^{-4}$, $C4=1.64032142\times10^{-5}$, and $C5=1.17802606\times10^{-7}$; with the expression valid for values of Z from 1.53 to 50.0 mm.

Illustratively, in a 110° deflection angle, 19V diagonal, embodiment of the system of FIG. 1, the throat of yoke mount 17 is contoured so that the active conductors of windings 13H may closely abut the outer surfaces of envelope sections 11F and 11N between transverse planes y and y' of FIG. 12 when the yoke assembly 13 is in its forwardmost position. The funnel contour of FIG. 12 illustratively permits a 5–6 mm pullback (for purity adjustment purposes) of a yoke of such (y-y') length from its forwardmost position without causing the beam to strike an envelope corner.

In FIG. 14*a*, the general shape of the $H_2$ nonuniformity function required of the horizontal deflection field to achieve self-converging results in an illustrative 110° embodiment of the FIG. 1 system is shown by solid line curve $HH_2$, with the abscissa representing location along the longitudinal tube axis (with the location of the Z=0 plane of FIG. 12 shown for location reference purposes), and with the ordinate representing degree of departure from field uniformity. In FIG. 14*a*, an upward displacement of curve $HH_2$ from the 0 axis (in the direction of arrow P) represents field non-uniformity of the "pincushion" type, wheras a downward displacement of curve $HH_2$ from the 0 axis (in the direction of arrow B) represents field non-uniformity of the "barrel" type. Dotted-line curve $HH_0$, plotted against the same location abscissa, shows the $H_0$ function of the horizontal deflection field to indicate the relative field intensity distribution along the tube axis. The positive lobe of curve $HH_2$ indicates the location of the strong pincushion shaped field region discussed previously as a cause of spot shape problems at raster sides.

In FIG. 14*b*, the general shape of the $H_2$ nonuniformity function required of a vertical deflection field companion to the FIG. 14*a* horizontal deflection field to achieve self-converging results is shown by curve $VH_2$, with absciassa and ordinate as in FIG. 14*a*. The accompanying dotted-line curve $VH_0$, revealing the $H_0$ function of the vertical deflection field, provides an indication of the relative field intensity distribution along the tube axis. The far left portion of curve $VH_0$ evidences the significant spillover of the vertical deflection field to the rear of the toroidal windings 13V, as was discussed above in connection with the advantages of beam "predistortion".

As suggested, for example, by the curves of FIG. 14*b* referenced to the contour of FIG. 12, the major deflecting action in the FIG. 1 system occurs in a region where proper funnel contouring allows yoke conductors to be brought close to the outermost beam paths. The absence of the neck size reduction resorted to in the "mini-neck" system is thus seen to be of little moment in realization of deflection efficiency. On the other hand, the absence of such reduction readily permits attainment of focus lens dimensions, impractical in a "mini-neck" tube, that ensure high focus quality without compromise of high voltage stability performance.

In FIG. 12, transverse planes c and c' indicate the location of the front and rear ends, respectively, of the core 15 in the above-discussed 110°, 19V embodiment of the system of FIG. 1. As shown, the axial distance (y-y') between front and rear ends of the active conductors of the horizontal windings 13H is significantly greater (illustratively, 1.4 times greater) than the axial distance (c—c') between front and rear ends of the core 15, with more than half (illustratively, 62.5%) of the extra conductor length disposed to the rear of the core 15. Illustrative dimensions for the c-y, y-y', and y'-c' plane spacings are approximately 500 mils, 2000 mils, and 300 mils, respectively.

Use of the feature of providing a significant rearward extension of the horizontal winding's active conductors beyond the core's rear end aids in lowering the stored energy (i.e., $\frac{1}{2}$ $I_H L_H^2$, in particular) demands of the system, and facilitiates rearward movement of the horizontal deflection center into substantial coincidence of location with the vertical deflection center. Limitations on this rearward thrust of the horizontal windings arise from considerations of neck clearance under desired yoke pullback conditions, and the impact on attainment of satisfactory beam convergence in raster corners. The relative positioning and axial length proportioning indicated in FIG. 12 for windings 13H and core 15 represents an acceptable compromise between conflicting demands imposed by desires for deflection efficiency enhancement, on the one hand, and attainment of acceptable corner convergence performance and yoke pullback range adequacy, on the other hand. As may be observed by comparing the $HH_0$ and $VH_0$ curves, of FIGS. 14*a* and 14*b* respectively, the relative locations indicated in FIG. 12 for windings 13H and core 15 result desirably in substantial coincidence of axial location for the respective peaks of the $HH_0$ and $VH_0$ intensity distribution functions.

What is claimed is:

1. A color image display system comprising:

a color picture tube including an evacuated envelope comprising a screen portion enclosing a display screen, a cylindrical neck portion, and a funnel portion connecting said screen portion and said neck portion;

an electron gun assembly, mounted within said neck portion, for producing three in-line electron beams;

a compact deflection yoke assembly encircling adjoining segments of said neck and funnel portions for developing deflection fields which permit tracing of display rasters on said screen with substantial convergence of said beams throughout the display, and which establish a given deflection angle between beam paths which terminate at diagonally opposed raster corners, said yoke assembly including horizontal deflection windings of saddle configuration defining respective windows, and vertical deflection windings of toroidal configuration, establishing respective deflection centers for said beams within the encircled region of said envelope;

said gun assembly including two main focusing electrodes at the beam exit end of said gun assembly maintained at different potentials, each of said main focusing electrodes including: a portion disposed transversely with respect to the longitudinal axis of said neck and having a trio of in-line apertures, through each of which a respectively different one of said beams passes; and an adjoining portion extending longitudinally therefrom and providing a common enclosure for the paths of all of said beams, the respective adjoining portions of said electrodes being juxtaposed to define therebetween a common main focusing lens for said beams from which said beam paths depart in converging fashion;

wherein the center-to-center spacing between adjacent apertures of each of said trios is such as to restrict the center-to-center spacing of adjacent ones of said beams to less than 200 mils in transverse planes occupied by said delfection centers, wherein the configurations of said juxtaposed portions establish a major transverse dimension for said main focusing lens of significantly more than three times said center-to-center spacing between adjacent apertures, wherein the diameter of said neck portion is sufficiently great that the interior surface of said neck portion is spaced from the outer surfaces of said juxtaposed enclosures, and wherein the internal diameter of said compact yoke assembly at the beam exit end of said windows totals less than 30 mils per degree of said deflection angle.

2. Apparatus in accordance with claim 1 wherein the maximum transverse dimension of said main focusing lens in a direction perpendicular to said major transverse dimension is less than said major transverse dimension but greater than said center-to-center spacing between adjacent apertures.

3. Apparatus in accordance with claim 2 wherein said electron gun assembly includes beam forming means for causing the cross-section of each beam at the entrance of said main focusing lens to exhibit a maximum dimension in the direction of said major transverse dimension of said main focusing lens which is greater than the maximum dimension thereof in a direction perpendicular to said major transverse dimension.

4. Apparatus in accordance with claim 3 wherein said beam forming means includes a trio of in-line cathodes, a frist grid positioned adjacent said in-line cathodes and having a trio of circular apertures, each aligned with a respectively different one of said cathodes; and a second grid positioned between said first grid and said main focusing lens and having a trio of circular apertures, each aligned with a respectively different one of said apertures of said first grid; said grids being maintained at different potentials and defining therebetween beam forming lenses for electrons emitted by said cathodes; and a slotted structure associated with one of said grids interposing a substantially rectangular slot between each circular aperture of said second grid and the respective aligned aperture of said first grid.

5. Apparatus in accordance with claim 4 wherein said slotted structure is associated with said first grid and incorporates three substantially rectangular slots, each of said slots being aligned with, and communicating with, a respectively different one of the circular apertures of said first grid, and having a dimension in a direction perpendicular to the direction of said major transverse dimension of said focusing lens which is appreciably greater than its dimension in the direction of said major transverse dimension.

6. Apparatus in accordance with claim 4 wherein said common enclosure provided by the one of said two main focusing electrodes which is more remote from the beam exit end of said gun assembly than the other exhibits an interior transverse dimension in a direction perpendicular to said major transverse dimension of said main focusing lens which is the same at the center of the central one of said beam paths as it is at the centers of the outer ones of said beam paths.

7. Apparatus in accordance with claim 6 wherein said common enclosure provided by said other of said two main focusing electrodes exhibits an interior transverse dimension in a direction perpendicular to said major transveres dimension of said main focusing lens which is less at the center of the central one of said beam paths than it is at the centers of the outer ones of said beam paths.

8. Apparatus in accordance with claim 7 wherein said juxtaposed enclosures of said two main focusing electrodes exhibit respective maximum interior transverse dimensions which differ from each other.

9. Apparatus in accordance with claim 8 wherein the maximum interior transverse dimension of said enclosure of said one of said two main focusing electrodes exceeds the maximum interior transverse dimension of said enclosure of said other of said two main focusing electrodes.

10. Apparatus in accordance with claim 9 wherein said one of said two main focusing electrodes is maintained at a potential equal to approximately 26% of the potential at which said other of said two main focusing electrodes is maintained.

11. Apparatus in accordance with claim 9 wherein said one of said two main focusing electrodes also includes a hollow, generally cylindrical portion of conductive, material surrounding all of said beams and extending from said apertured, transversely disposed portion of said one electrode to the vicinity of said second grid; said apparatus also including an enclosure of magnetizable material of relatively high permeability which is fitted within a segment of said cylindrical portion adjoining said second grid, and which shields enclosed portions of the paths of said beams from magnetic fields developed by said yoke assembly.

12. Apparatus in accordance with claim 11 wherein said magnetizable enclosure extends along less than one-fourth of the axial length of said one electrode.

13. Apparatus in accordance with claim 6 also including two auxiliary focusing electrodes enclosing successive portions of the paths of said beams and interposed between said second grid and said one of said two main focusing electrodes.

14. Apparatus in accordance with claim 13 wherein the one of said two auxiliary focusing electrodes which adjoins said second grid is maintained at the same potential as said one of said two main focusing electrodes, and wherein the other of said two auxiliary focusing electrodes is maintained at the same potential as said other of said two main focusing electrodes.

15. Apparatus in accordance with claim 14 wherein said one of said two auxiliary focusing electrodes comprises an enclosure of magnetizable material of relatively high permeability encircling portions of the paths of said beams and shielding said encircled beam path portions from magnetic fields developed by said yoke assembly.

16. Apparatus in accordance with claims 1 or 6 wherein the minimum spacing between said interior surface of said neck portion and said outer surfaces of said juxtaposed enclosures exceeds 30 mils.

17. Apparatus in accordance with claim 16 wherein the outer diameter of said neck portion is approximately 1145 mils.

18. Apparatus in accordance with claims 1 or 6 wherein said compact deflection yoke assembly includes a generally toroidal core of magnetizable material about which said vertical deflection windings are toroidally wound, and wherein the positioning of said horizontal deflection windings relative to said core locates the beam entrance end of said windows more remotely from said display screen than the beam entrance end of said core, with the axial spacing between said beam entrance ends equal to a significant prcentage of the axial spacing between opposite ends of said windows.

19. Apparatus in accordance with claim 18 wherein said axial spacing between said beam entrance ends is equal to more than one-sixth of said axial spacing between opposite ends of said windows.

20. Apparatus in accordance with claims 1 or 6 wherein said compact yoke assembly includes a hollow core of magnetizable material disposed about a portion of said encircled region of said envelope, said vertical deflection windings being toroidally wound about said core; and wherein the positioning of said horizontal deflection windings along the longitudinal axis of said tube relative to the positioning of said core along said axis offcenters said windows relative to said core's location in a direction away from said screen.

21. A color image display system comprising:

a color picture tube including an evacuated envelope comprising a screen portion enclosing a display screen, a cylindrical neck portion, and a funnel portion connecting said screen portion and said neck portion;

an electron gun assembly, mounted within said neck portion, for producing three in-line electron beams; and a compact deflection yoke assembly encircling adjoining segments of said neck and funnel portions for developing deflection fields which permit tracing of display rasters on said screen with substantial convergence of said beams throughout the display, and which establish a given deflection angle between beam paths which terminate at diagonally opposed raster corners, said yoke assembly including horizontal deflection windings of saddle configuration defining respective windows, and vertical deflection windings of toroidal configuration, establishing respective deflection centers for said beams within the encircled region of said envelope;

wherein said electron gun assembly comprises:

focusing means for establishing a common, asymmetric, main focusing lens for said beams from which said beam paths depart in converging fashion, said focusing lens being disposed transversely with respect to the paths of said beams and exhibiting a major transverse dimension in a first direction which is greater than the maximum transverse dimension in a second direction orthogonal to the first; and means, preceding said focusing means, for shaping each of said beams so that the cross-section of each of said beams at the entrance of said focusing lens has a greater dimension in said first direction than in said second direction, said major transverse dimension of said focusing lens being more than three times the center-to-center spacing between adjacent ones of said beams at said lens entrance;

wherein said compact deflection yoke assembly includes a generally toroidal core of magnetizable material about which said vertical deflection windings are toroidally wound; and wherein the positioning of said horizontal deflection windings relative to said core is such as to locate the beam entrance end of said windows more remotely from said display screen than the beam entrance end of said core, and to offcenter said windows relative to said core's location in a direction away from said screen.

22. Apparatus in accordance with claim 21, wherein the internal diameter of said compact yoke assembly at the beam exit end of said windows totals less than 30 mils per degree of said deflection angle, and the center-to-center spacing of adjacent ones of said beams is restricted to less than 200 mils in transverse planes occupied by said deflection centers.

23. A color image display system comprising:

a color picture tube including an evacuated envelope comprising a screen portion enclosing a display screen, a cylindrical neck portion, and a funnel portion connecting said screen portion and said neck portion;

an electron gun assembly, mounted within said neck portion, for producing three in-line electron beams; and a compact deflection yoke assembly encircling adjoining segments of said neck and funnel portions for developing deflection fields which permit tracing of display rasters on said screen with substantial convergence of said beams throughout the display, and which establish a given deflection angle between beam paths which terminate at diagonally opposed raster corners, said yoke assembly including horizontal deflection windings of saddle configuration defining respective windows, and vertical deflection windings of toroidal configuration, establishing respective deflection centers for said beams within the encircled region of said envelope;

wherein said electron gun asesmbly comprises:

focusing means for establishing a common, asymmetric, main focusing lens for said beams from which said beam paths depart in converging fashion, said focusing lens being disposed transversely with respect to the paths of said beams and exhibiting a major transverse dimension in a first direction which is greater than the maximum transverse dimension in a second direction orthogonal to the first; and means, preceding said focusing means, for shaping each of said beams so that the cross-section of each of said beams at the entrance of said focusing lens has a greater dimension in said first direction than in said second direction, said major transverse dimension of said focusing lens being more than three times the center-to-center spacing between adjacent ones of said beams at said lens entrance;

and wherein the internal diameter of said compact yoke assembly at the beam exit end of said windows totals less than 30 mils per degree of said deflection angle.

24. Apparatus in accordance with claim 23, wherein said gun assembly restricts the center-to-center spacing of adjacent ones of said beams to less than 200 mils in transverse planes occupied by said deflection centers.

25. Apparatus in accordance with claim 24, wherein said maximum transverse dimension of said focusing lens in said second direction is greater than said center-to-center spacing between adjacent ones of said beams at said lens entrance.

* * * * *